United States Patent [19]

Amano et al.

[11] Patent Number: 4,852,010

[45] Date of Patent: Jul. 25, 1989

[54] LEARNING CONTROL METHOD FOR INTERNAL COMBUSTION ENGINES

[75] Inventors: Matsuo Amano, Hitachi; Seiji Suda, Mito; Nobuo Satou, Iwaki, all of Japan

[73] Assignee: Hitachi, Ltd., Tokyo, Japan

[21] Appl. No.: 886,736

[22] Filed: Jul. 18, 1986

[30] Foreign Application Priority Data

Jul. 24, 1985 [JP] Japan ..... 60-161921

[51] Int. Cl.[4] ..... F02M 17/00

[52] U.S. Cl. ..... 364/431.03; 364/431.05; 364/581; 123/480; 123/489

[58] Field of Search ..... 123/478, 489, 480, 479; 364/431.03, 431.05, 431.06, 581

[56] References Cited

U.S. PATENT DOCUMENTS

| | | | |
|---|---|---|---|
| 4,348,727 | 9/1982 | Kobayashi et al. | 364/431.06 |
| 4,413,601 | 11/1983 | Matsuoka et al. | 123/480 |
| 4,438,497 | 3/1984 | Willis et al. | 123/489 |
| 4,442,815 | 4/1984 | Ninomiya | 364/431.05 |
| 4,467,770 | 8/1984 | Arimura et al. | 123/489 |
| 4,594,985 | 6/1986 | Fujimura et al. | 123/489 |
| 4,633,841 | 1/1987 | Matsuura et al. | 123/478 |
| 4,703,430 | 10/1987 | Amano et al. | 364/431.05 |
| 4,729,359 | 3/1988 | Tomisawa et al. | 123/489 |
| 4,730,255 | 3/1988 | Akiyama et al. | 364/431.05 |
| 4,733,357 | 3/1988 | Abe | 123/489 |
| 4,737,914 | 4/1988 | Abe et al. | 123/489 |

FOREIGN PATENT DOCUMENTS 0145992 6/1985 European Pat. Off. .

*Primary Examiner*—Parshotam S. Lall
*Assistant Examiner*—Ellis B. Ramirez
*Attorney, Agent, or Firm*—Antonelli, Terry & Wands

[57] ABSTRACT

A learning map on which the rewriting of data is performed in accordance with the results of an internal combustion engine controlling operation is provided. When the number of pieces of data written in this learning map has become greater than one, the corresponding weighting is done for each unlearned region in the basis of the learning data on the learning already-learned regions, and the data in the already learned regions is written in unlearned region. The controlling of the engine is performed on the basis of the data written in the learning map.

9 Claims, 10 Drawing Sheets

LEARNING CONTROL METHOD FOR INTERNAL COMBUSTION ENGINES

BACKGROUND OF THE INVENTION

1. Field of the Invention:

This invention relates to a method of controlling a gasoline engine for automobiles, and more particularly to a method of controlling such an engine by using a learning map.

2. Description of the Prior Art:

In a conventional learning map rewriting process, a learning map is created by memorizing the results of an internal combustion engine controlling operation with respect to each section of the operational condition of the engine, and leaving an old map value with respect to a section of the operational condition, in which the engine is not set for a long period of time, of the engine, as disclosed in, for example, Japanese Patent Laid-open No. 106040/1981 entitles "Engine Control Method" and published on Aug. 24, 1981. Therefore, in the conventional learning map rewriting process, the map values are determined so that an air-fuel ratio, which is determined on the basis of the condition of the engine as the time elapses or as the rotation of the engine progresses, can be controlled to an optimum level irrespective of a feedback factor. However, in this conventional control method, no consideration is given to an operation for writing data on an unlearned region into a memory after an initial learning value has been determined.

SUMMARY OF THE INVENTION

An object of the present invention is to provide a learning control method for internal combustion engines, which is capable of creating a suitable learning map speedily, and carrying out a correct control operation based on a learning map in a short period of time after the learning has been started.

In a prior art control method of this kind, the attainment of a predetermined learning number or a predetermined period of learning time is checked during the creation of a learning map for each section of the condition of an engine. However, in an initial learning operation, it takes a considerably long period of time before the learning number has reached a predetermined level. Therefore, it takes much time before a learning control operation has been started, i.e., the responding capability of the learning control means becomes low. If a learning map creating operation is carried out a certain period of time after the starting of a learning operation, by writing an already-learned value in a region, which is in the vicinity of an unlearned region, into the unlearned region in spite of a small learning number, the accuracy of a A/F control operation decreases.

Therefore, in order to achieve the above-mentioned object, an initial map creating operation in the present invention is carried out by weighting the learning map in accordance with the learning number when the learning number has reached a value greater than one, to write the data into an unlearned region. In the second learning map creating operation onward, the rewriting is done when a difference between the learning number in a preceding learning map and that in the learning map being created has become greater than five or six. As a result, an A/F control operation can be carried out with a new learning value, so that the convergency of a learning control operation can be improved.

Figure 2:
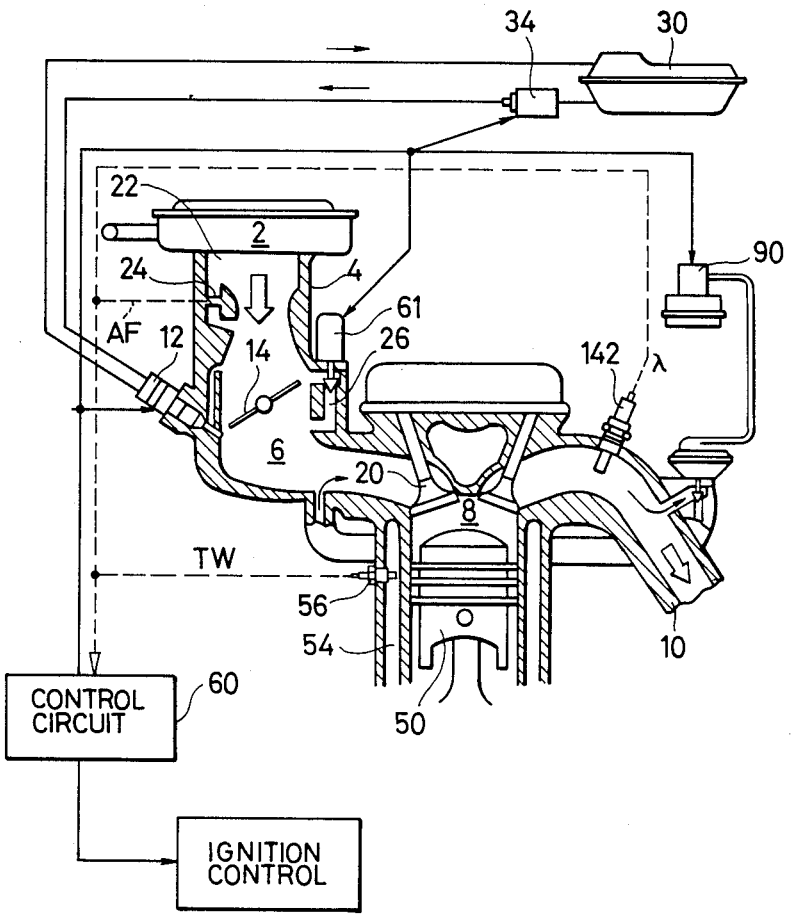
FIG. 2 PRIOR ART
FIG. 2 is an example of a construction diagram of an electronic engine system to which the present invention is applied.
Figure 3:
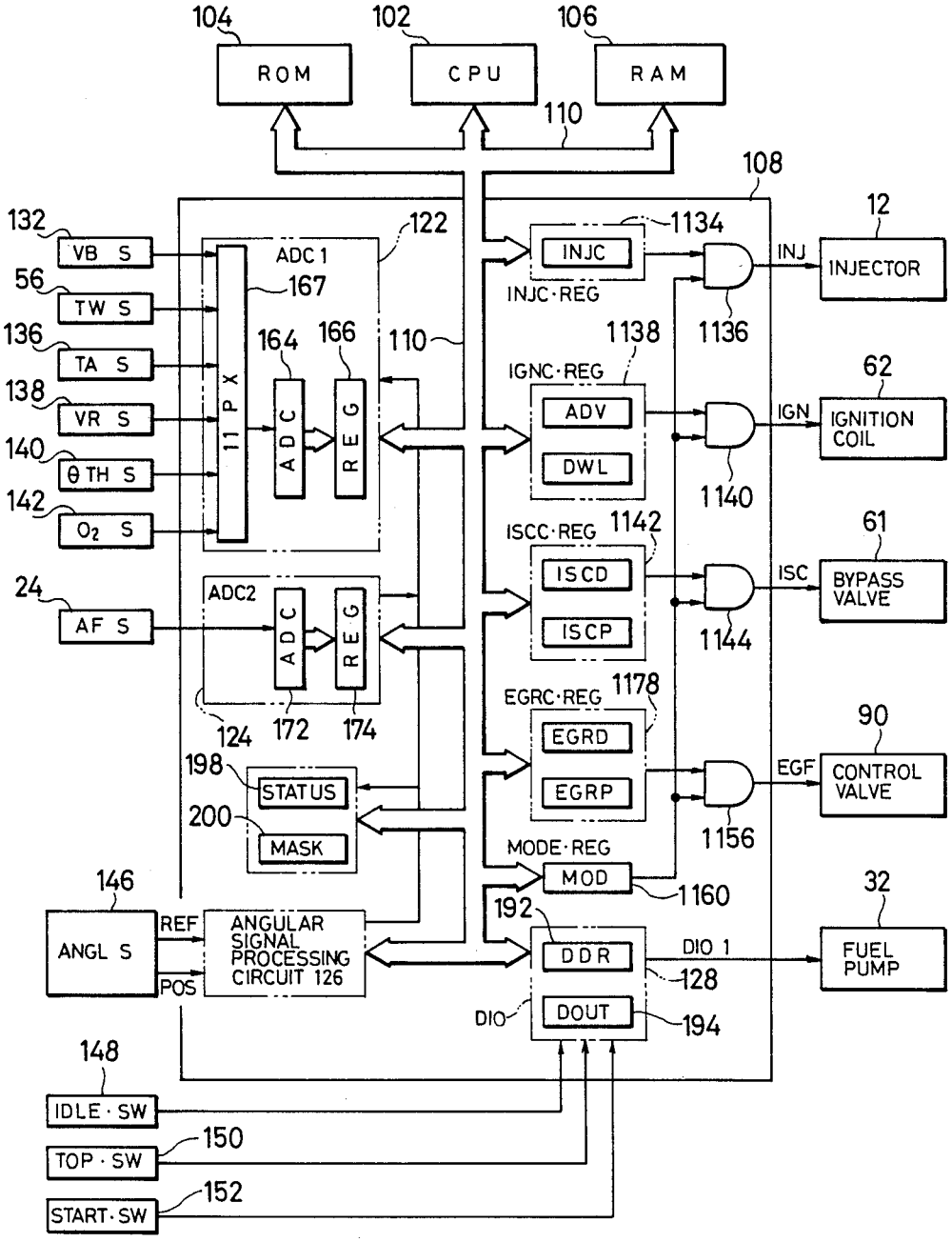
FIG. 3 PRIOR ART
FIG. 3 is a block diagram of a control circuit for the system shown in FIG. 2.

DESCRIPTION OF THE PREFERRED EMBODIMENT:

FIG. 2 is a partially sectioned schematic diagram of an engine, and FIG. 3 is a general construction diagram of a control circuit 60 using a microcomputer. The construction of the hardware in the system shown in FIGS. 2 and 3 is disclosed in, for example, Japanese Patent Laid-open No. 106040/1981 entitled "Engine Control Method" and published on Oct. 20, 1980.

Referring to FIG. 2, the suction air flows through an air cleaner 2, a throttle chamber 4 and a suction pipe 6 to be fed into a cylinder 8. A gas burnt in the cylinder 8 flows therefrom into an exhaust pipe 10 from which the combustion gas is discharged to the atmospheric air.

The throttle chamber 4 is provided with an injector 12 for ejecting a fuel into throttle chamber 4. The fuel ejected from this injector 12 is atomized in an air passage in the throttle chamber 4 and mixed with the suction air to form a gaseous mixture, which flows through the suction pipe 6 to be fed into a combustion chamber in the cylinder 8 when a suction valve 20 is opened.

A throttle valve 14 is provided in the vicinity of an outlet of the injector 12. The throttle valve 14 is formed so that it is operated mechanically in accordance with an operation of an acceleration pedal by a driver.

An air bypass passage 22 is provided on the upstream side of the throttle valve 14 in the throttle chamber 4. This air bypass passage 22 is provided therein with a hot-wire type air flow meter consisting of an electric heating element, i.e. a flow rate sensor 24, from which an electric signal AF, the level of which varies depending upon the velocity of flow of the air, is taken out. Since this flow rate sensor 24 consisting of a heating element (hot wire) is provided in the air bypass passage 22, it can be protected against a high-temperature gas, which occurs when a backfire from the cylinder 8 takes place, and also against contamination with the dust in the suction air. An outlet of this air bypass passage is opened in a position which is in the vicinity of the narrowest portion of a venturi, and an inlet thereof in a position which is on the upstream side of the venturi.

A pressurized fuel is supplied constantly from a fuel tank 30 in to the injector 12 via a fuel pump 34. When an injection signal from a control circuit 60 is applied to the injector 12, the fuel is ejected therefrom into the suction pipe 6.

The gaseous mixture sucked from the suction valve 20 is compressed by a piston 50, and burnt by the sparks from an ignition plug (not shown), and the resultant combustion energy is converted into kinetic energy. The cylinder 8 is cooled with the cooling water 54. The temperature of this cooling water is measured with a water temperature sensor 56, and this measurement value TW is utilized as an engine temperature.

The portion of the engine in which the exhaust pipes 10 are collected is provided with an oxygen sensor 142, which is adapted to be turned on and off in accordance with a theoretical air-fuel ratio.

A crankshaft (not shown) is provided thereon with a crank angle sensor which is adapted to output a reference angle signal and a position signal at each reference crank angle and at each predetermined angle (for example, 0.5°) in accordance with the rotation of the engine.

An output signal from the crank angle sensor, an output signal TW from the water temperature sensor 56, an output signal from the oxygen sensor 142 and an electric signal AF from the heating element 24 are applied to the control circuit 60, which consists of a microcomputer and a memory, and used as input signals for controlling the injector 12 and an ignition coil 62 which is shown in FIG. 3.

The throttle chamber 4 is provided therein with a bypass 26 which extends over the throttle valve 14 to be communicated with the suction pipe 6. This bypass 26 is provided therein with an idling control bypass valve 61 which is adapted to be opened and closed by a control means.

This bypass valve 61 extends into the bypass 26, which is provided so as to shunt the throttle valve 14, and the opening and closing thereof is controlled by a pulse current. The crosssectional area of the bypass 26 is varied in accordance with the lift of the bypass valve 61. The lift of the bypass valve 61 is controlled by a driving means in accordance with the level of an output from the control circuit 60. Namely, a periodic opening and closing signal for controlling the driving means is generated in the control circuit 60, and the lift of the bypass valve 61 is regulated by the driving means in accordance with the levels of these periodic opening and closing signals.

EGR (Exhaust Gas Recirculation) control valve 90 is adapted to control the cross-section 1 area of a passage between the exhaust pipe 10 and suction pipe 6, whereby the rate of EGR from the exhaust pipe 10 to the suction pipe 6 is controlled.

Therefore, the controlling of the air-fuel ration (A/F) and the increasing and decreasing of the quantity of fuel is done by controlling the operation of the injector 12, and the number of rotations of the engine during an idling operation can be controlled (idling speed control (ISC)) by controlling the operations of the bypass valve 61 and injector 12, the EGR rate being also able to be controlled.

Referring to FIG. 3, the control circuit 60 consists of a central processing unit 102 (which will hereinafter be referred to as CPU), a read-only memory 104 (which will hereinafter be referred to as ROM), a random access memory 106 (which will hereinafter be referred to as RAM) and an input/output circuit 108. CPU 102 is adapted to compute the input data from the input/output circuit 108 on the basis of various programs stored in ROM 104, and return the results of the computation to the input/output circuit 108. The intermediate memorization required for this computation is done by using RAM 106. The outputting and receiving of various data between CPU 102, ROM 104, ROM 106 and input/output circuit 108 is done through a bus line consisting of a data bus, a control bus and an address bus.

The input/output circuit 108 has input means for a first analog-digital converter 122 (which will hereinafter be referred to as ADC1), a second analog-digital converter 124 (which will hereinafter be referred to as ADC2), an angle signal processing circuit 126, and a discrete input/output circuit 128 (which will hereinafter be referred to as DIO) for use in inputting and outputting one-bit information.

The outputs from a battery voltage detecting sensor 132 (which will hereinafter be referred to as VBS), a cooling water temperature sensor 56 (which will hereinafter be referred to as TWS), a temperature sensor 136 for the engine cooling water (which will hereinafter be referred to as TA), an exhaust gas regulating knob 138 (which will hereinafter be referred to as VRS) used during an idling operation, an oxygen sensor 142 (which will hereinafter be referred to as $O_2S$) and a throttle sensor 140 (which will hereinafter be referred to as OTHS) are applied to a multiplexer 167 (which will hereinafter be referred to as MPX) in ADC1. In MPX 167, one of these inputted signals is selected, and the selected signal is inputted into an analog-digital conversion circuit 164 (which will hereinafter be referred to as ADC). A digital value, an output from ADC 164, is held in a register 166 (which will hereinafter be referred to as REG).

An output from the flow rate sensor 24 (which will hereinafter be referred to as AFS) is inputted into ADC 124, and subjected to digital conversion through an analog-digital conversion circuit 172 (which will hereinafter be referred to as ADC), the resultant signal being set in a register 174 (which will hereinafter be referred to as REG).

A signal (which will hereinafter be referred to as REF) representative of a reference crank angle, for example, a 180° crank angle (in the case of a 4-cylinder engine) and a signal (which will hereinafter be referred to as (POS) representative of a fine crank angle, for example a 1° crank angle are outputted from an angle sensor 146 (which will hereinafter be referred to as ANGLS) and applied to the angle signal processing circuit 126, in which these signals are subjected to waveform shaping.

DIO 128 is adapted to receive a signal from an idle switch 148 (which will hereinafter be referred to as IDLE-SW) which is operated when the throttle valve is returned to a fully-closed position, and signals from a top gear switch 150 (which will hereinafter be referred to as TOP-SW) and a starter switch 152 (which will hereinafter be referred to as START-SW).

The pulse output circuit based on the results of computation in CPU and the object parts to be controlled will now be described. An injector control circuit 1134 (which will hereinafter be referred to as INJC) is a circuit for use in converting a digital value in the results of computation into a pulse output. Accordingly, a pulse INJ having a pulse width corresponding to a fuel injection rate is generated in INJC 1134 and applied to the injector 12 through an AND gate 1136.

An ignition pulse generating circuit 1138 (which will hereinafter be referred to as IGNC) has an ignition time setting register (which will hereinafter be referred to as ADV), and a register (which will hereinafter be referred to as DWL) for setting the time for starting the application of a primary current to an ignition coil, and this data is set by CPU. A pulse IGN is generated on the basis of the set data, and applied to an amplifier 62, which is used to supply a primary current to the ignition coil, through an AND gate 1140.

The degree of opening of the bypass valve 61 is controlled by a pulse ISC supplied by a control circuit (which will hereinafter be referred to as ISC) 1142 thereto through an AND gate 1144. ISCC 1142 has a pulse width setting register ISCD and a pulse period setting register ISCP.

An EGR rate control pulse generating circuit 1178 (which will hereinafter be referred to as EGRC) for controlling the EGR control valve 90 has a register EGRD for setting a value representative of pulse duty, and a register EGRP for setting a value representative of a pulse period. An output pulse EGR from EGRC is applied to EGR 90 through an AND gate 1156.

A one-bit input/output signal is controlled by the circuit DIO 128. The input signals include IDLE-SW signal, START-SW signal and TOP-SW signal. The output signals include a fuel pump driving pulse signal. DIO is provided with an input/output determining register DDR 192 and an output data latching register DOUT 194.

A mode register 1160 is a register (which will hereinafter be referred to as MOD) holding commands for instructing various kinds of conditions in the input/output circuit 108. For example, a command is given to this mode register 1160 to turn on or off all of AND gates 1136, 1140, 1144, 1156. The interruption and starting of the generation of outputs from INJC, IGNC, ISCC and EGRC can be controlled by setting a command in MOD register in this manner.

A signal DIO1 for controlling the fuel pump 32 is outputed from DIO 128.

Therefore, if such an electronic engine control (EEC) method is utilized, substantially all control operations for an internal combustion engine, such as an A/F control operation can be suitably carried out, and this method will certainly enable an automobile to meet the severe exhaust gas regulations.

In EEC shown in FIGS. 2 and 3, the injection of a fuel by the injector 12 is done periodically and synchronously with the rotation of the engine, and the fuel injection rate is controlled by controlling the valve-opening time of the injector 12 during one injection operation, i.e. the injection time Ti.

Therefore, in the embodiment of the present invention, the injection time Ti is defined as follows.

$$Ti=\alpha T_P(Kl+Kacc+K_{DEC})\ COEF+T_S \quad (1)$$

$$T_P=k\ Q_A/N \quad (2)$$

wherein k is a factor determined by the injector; $T_p$ the basic fuel injection time; $\alpha$ an air fuel ratio compensation factor; Kl a learning factor; Kacc an acceleration learning factor; $K_{DEC}$ a deceleration learning factor; COEF the sum of various compensation factors; $Q_A$ a flow rate of suction air; N the number of rotations of the engine; and $T_S$ the battery voltage compensation time.

The basic fuel injection time $T_P$ is determined on the basis of the flow rate $Q_A$ of the suction air in the engine and the number of rotations N of the engine in accordance with equation (2) so as to obtain an approximate theoretical air-fuel ratio (A/F=14.7). The correction of the air-fuel ratio is made by carrying out the feedback control of the air-fuel ratio compensation factor $\alpha$ in accordance with a signal from the oxygen sensor 142, so as to obtain an accurate theoretical air-fuel ratio. The correction of the scatter of the characteristics and the variations with the lapse of time of various actuators and sensors, related to the controlling of the air-fuel ratio, is then made on the basis of the learning factor Kl.

Figure 4:
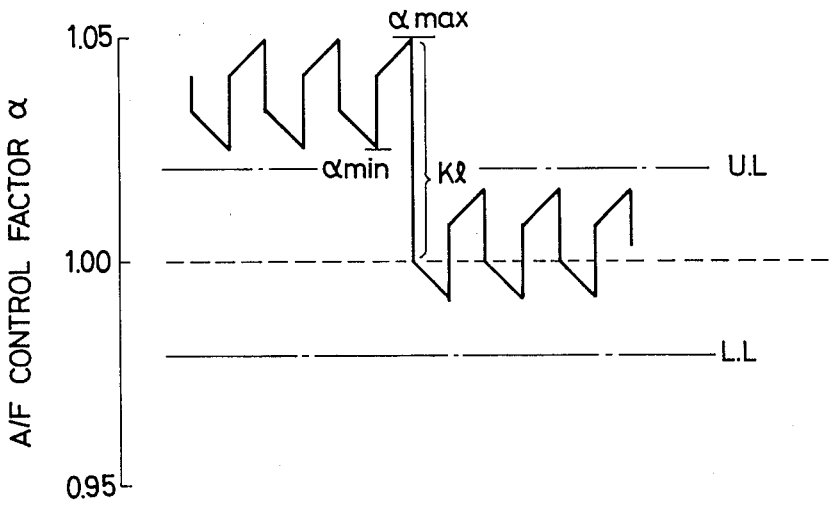
FIG. 4 is a diagram showing the air-fuel ratio compensation factors.

First, the learning factor Kl will be described. The oxygen sensor 142 is adapted to output a binary signal (high and low level voltages) in accordance with the presence and absence of oxygen in an exhaust gas. It is well known that the air-fuel ratio is controlled by increasing or decreasing the air-fuel ratio compensation factor $\alpha$ in a stepped manner on the basis of this binary signal, and then increasing or decreasing the same factor gradually. The air-fuel ratio compensation factor $\alpha$ varying with the detected level of an actual air-fuel ratio, which is represented by an output signal 142 from the oxygen sensor, is shown in FIG. 4.

Let $\alpha$equal the air-fuel ratio compensation factor obtained when a signal from the oxygen sensor is reversed due to a variation of an actual air-fuel ratio to a level higher or lower than $\lambda=1$ (A/F=14.7), $\alpha_{max}$ an extreme value of the factor at the point in time at which the air-fuel ratio varies from a low level to a high level, and $\alpha_{min}$ an extreme value of the factor at the point in time at which the air-fuel ratio varies from a high level to a low level. When the maximum value $\alpha_{max}$ of the air-fuel compensation factor is larger than an upper limit value (UL), or when the minimum value $\alpha_{min}$ thereof is smaller than a lower limit value (LL), a deviation Kl with respect to a value 1.0 of air-fuel ratio compensation factor is determined as a learning quantity. The computation of this learning quantity Kl is done in all regions in which the feedback compensation by the oxygen sensor 142 is carried out.

Figure 5:
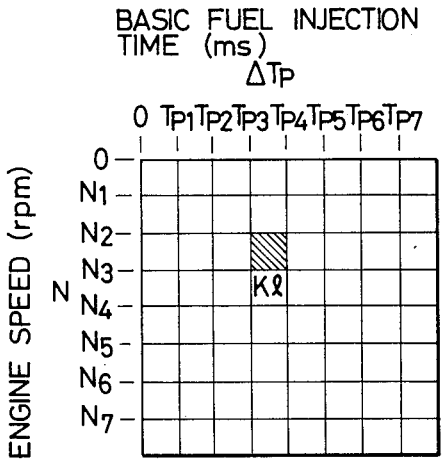
FIG. 5 is a construction diagram of a learning map used in the present invention.

FIG. 5 shown a table into which the learning quantity Kl is written. In this table, Kl is written at a dividing point which is determined by the basic fuel injection time $T_p$ and the number N of rotations of the engine. This learning is done when a frequency in a case where the maximum value $\alpha_{max}$ and minimum value $\alpha_{min}$ of the air-fuel ratio compensation factor are not equal to the upper limit value (UL) or lower limit value (LL) with the dividing point not varied has become n. The table shown in FIG. 5 is defined as a learning map.

In this embodiment, the learning is done for each divisional region. In practice, the results of learning are not usually obtained in all the regions of a learning map. Therefore, it is necessary that an unlearned divisional region be filled with reference to a learned region. A method of creating such a learning map will now be described.

Figure 6:
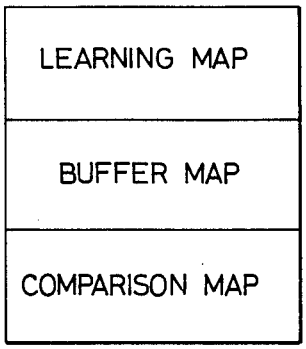
FIG. 6 is a construction diagram of maps used in the present invention.
Figure 7:
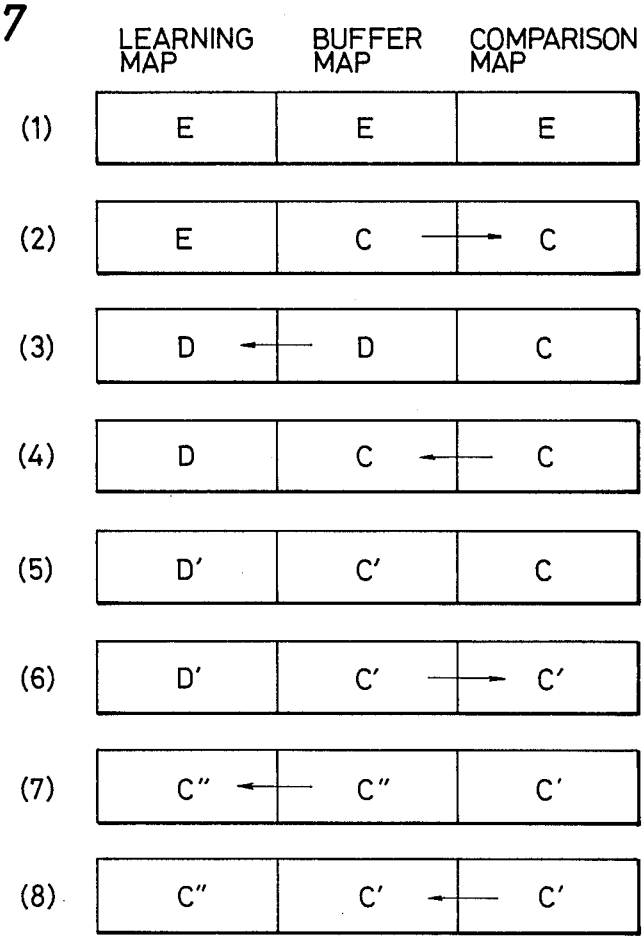
FIG. 7 is a diagram showing a map creating routine in the present invention.

FIG. 6 shows the construction of a buffer map and a comparison map, each of which has divisional regions the number of which is equal to that of a learning map, and each of which is used to create a learning map. The learning map creating routine using these maps is shown in a block diagram of FIG. 7. Referring to FIG. 7, (1)-(4) denotes the first learning, and (5)-(8) the learning for the second time onward. In (1) in FIG. 7, the whole of the learning map and comparison map are cleared and in an empty (E) state, and a learning quantity is written in the buffer map. However, in this stage of a learning map creating operation, the double writing of data in the same address in the buffer map is not done. When the number of writings into the buffer map has become C in (2), the content of the buffer map is transferred to the comparison map. In (3), the writing (D) of data in an unlearned region of the buffer map is done with reference to the C pieces of information written in the buffer map, and the content of (D) is transferred to the learning map. For example, if the value of only one Kl written in the regions $T_{P3}-T_{P4}$ and $N_2-N_3$ is 0.5, the value of Kl weighted and written in the regions $T_P=O-T_{P1}$ and $N=O-N_1$ is, for example, 0.2, the value of Kl weighted and written in the regions $T_P=O-T_{P1}$ and $N_7$ onward 0.3, the value of Kl weighted and written in the regions $T_{P7}$ onward and $N=O-N_1$ 0.4, and the value of Kl weighted and written in the regions $T_{P7}$ onward and $N_7$ onward 0.6. The weighting values thus differ depending upon the portion, in which the data is to be written, of an unlearned region. As the number of learned regions of the buffer map increases, the weighting value becomes closer to 1.0

The transfer of data from the buffer map to the learning map is done as follows. The compensation factors Kl written in the buffer map and Kl written in the comparison map are compared, i.e., the values of the compensation factors written in all regions of both of these maps are compared. When the difference between the values of these compensation factors has reached a predetermined level, the compensation factors in the buffer map are rewritten in the learning map. The comparison map is thus provided in addition to the buffer map for the purpose of comparing the variation with the lapse of time of the compensation factors.

In (4), the content of the comparison map is transferred to the buffer map. From this point in time, the value of the learning quantity Kl in the learning map is used in the calculation of the fuel injection time. In (5) onward, the learning value is written simultaneously in both the learning map and buffer map to create maps D', C', and the contents C', C of the buffer map and comparison map are compared. When the number of differences in the contents thus compared of these two maps has reached a predetermined level, the operations similar to those in (2)-(4) are carried out in (6)-(8). The C mentioned above is, for example, 1. When C is 1, it is possible that the learning quantity has a special value. Accordingly, the learning by setting a half of the learning value Kl as a learning value is generally done. When C is 2, $\frac{3}{4}$ of the learning value Kl is set as a learning value. When C is not less than 3, the learning value Kl itself is set as a learning value.

Figure 8:
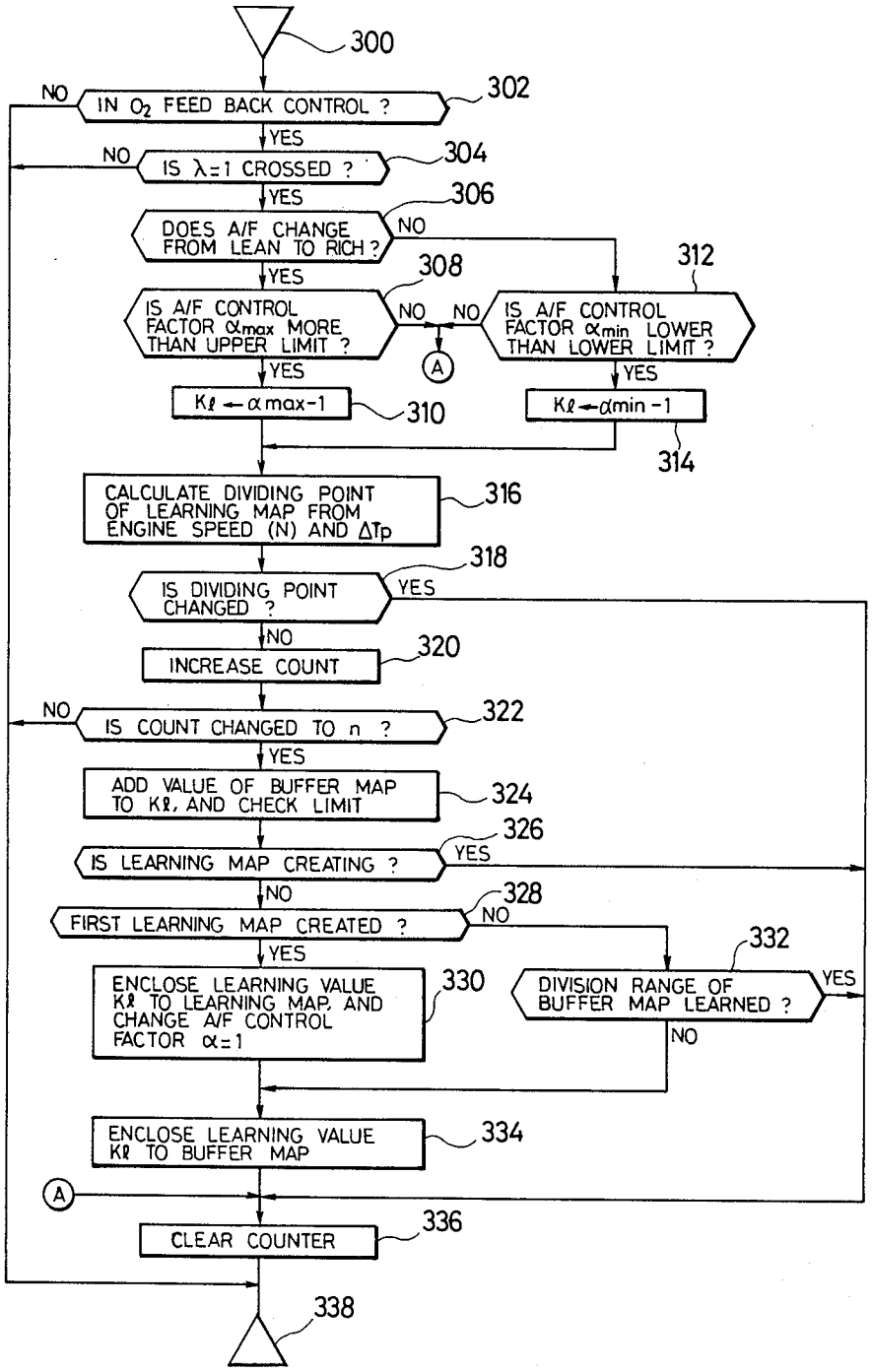
FIG. 8 is a flow chart of an example of a learning map creating operation in the present invention.

An example of a learning routine of the learning factor (learning quantity) Kl will now be described with reference to FIG. 8. A process according to this flow chart, i.e. the steps 300-338 are repeated in a predetermined cycle after the engine has been started. First, in a step 302, the determination of whether an oxygen feedback control operation has already been started is made, and, when the result is affirmative, the operation is advanced to a step 304. When the result is negative, the operation is advanced to a step 338. In the step 304, the determination of whether a signal from the oxygen sensor has crossed $\lambda=1$ (theoretical air-fuel ratio $A/F=14.7$) is made. When the result is negative, the operation is advanced to the step 338, and the known computation of air-fuel ratio compensation factor is done. When the result is affirmative, the operation is advanced to a step 306 to check the reversed condition of the oxygen sensor. When the actual air-fuel ratio has decreased from a high level, the operation is advanced to a step 308 to check the maximum value $\alpha_{max}$ of air-fuel ratio compensation factor as to whether it is not lower than the upper limit level. When the maximum value $\alpha_{max}$ is not lower than the upper limit level, the difference between $\alpha_{max}$ and 1 is set as the learning quantity Kl in a step 310. When the air-fuel ratio has decreased from a high level to a low level in the step 306, the operation is advanced to a step 312 to check the minimum value $\alpha_{min}$ of the air-fuel ratio factor as to whether it is not higher than the lower limit level. When the minimum value $\alpha_{min}$ is not higher than the lower limit level, the difference between $\alpha_{min}$ and 1 is set as the learning quantity Kl in a step 314. The operation is advanced from the steps 310, 314 to a step 316, in which the dividing points in the learning map are calculated on the basis of the rotation axis representing the number of rotations of the engine and the load axis representing the fuel injection time, which is shown in FIG. 5. In a step 318, the currently calculated dividing points are checked as to whether they are different from the dividing points calculated one period before. When the currently calculated dividing points have no variations, the counter is incremented in a step 320 to monitor the time (about 150 ms) in which the condition of the engine is in the same region. In a step 322, a new learning value is added to the old learning value in a predetermined region of the buffer map for the purpose of memorizing the new learning value in a step 324 when the indication on the counter has become n, and the added value is checked with a limit as to whether it is not lower than the allowable memorization value of the memory. If the learning map is being created in a step 326, the operation is advanced to a step 336. If the learning map is not being created in the step 326, the initial learning map is checked in a step 328 as to whether the creation thereof has been completed. If the creation of the initial learning map has been completed, the operation is advanced to the second learning in a step 330. In the step 330, the learning value Kl is stored in the learning map, and the air-fuel ratio compensation factor $\alpha$ is set to 1.0. If the creation of the initial learning map has not yet been completed, and, if the divisional region in the buffer map has already been learned, which is the first learning, in a step 332, the operation is advanced to a step 336 without carrying out double writing. If this divisional region has not yet been learned, the learning value Kl is stored in the buffer map in a step 334, and the counter is cleared in a step 336.

According to the present invention described above, which relates to a fuel control system for a internal combustion engine, such as a gasoline engine, a deviation from the theoretical air-fuel ratio, especially, in a fuel control operation can be checked, and the standard characteristics of the sensors and actuators can always be obtained without specifically regulating the scatter of and the variations with the lapse of time in the characteristics of these parts.

The learning value Kl is described by using differences between the maximum and minimum values $\alpha_{max}$, $\alpha_{min}$ of the air-fuel ratio compensation factor and 1.0 but Kl in the present invention is not limited to the values thus obtained; a difference between the maximum value $\alpha_{max}$ and 1.02 and a difference between the minimum value $\alpha_{min}$ and 0.98 may be used.

Figure 1:
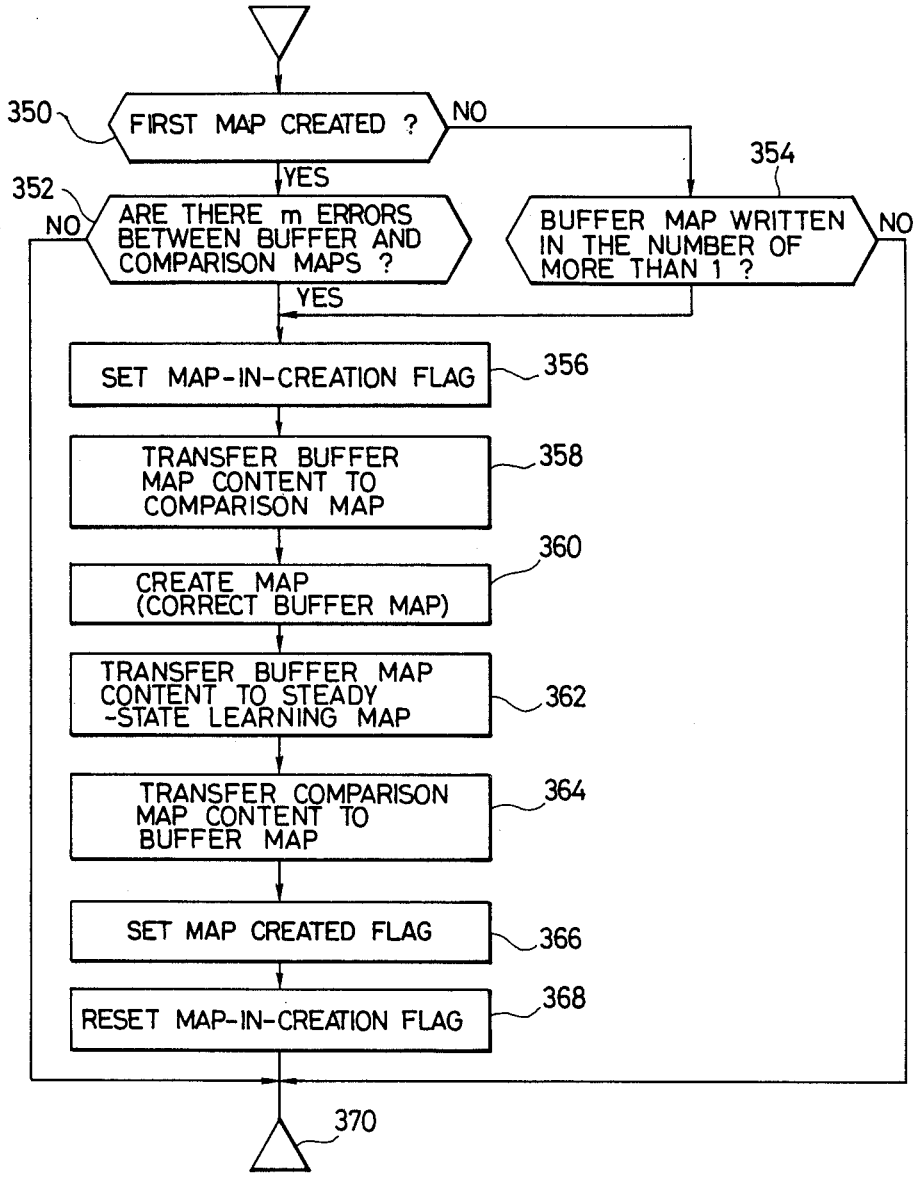
FIG. 1 is a flow chart of an example of a learning map creating operation according to the present invention.

The learning map creation routine illustrated in FIG. 7 will now be described with reference to the flow chart of FIG. 1. In a step 350, the determination of whether the first map has been created is made. If this map has not yet been created, the operation is advanced to a step 354 to check the number of writings into the buffer map. The weighting is done in accordance with the number of learnings of 1–3, and the operation is advanced to a step 356. If the learning has not been done, the operation is advanced toward a step 370. If the first learning map has been created in the step 350, differences between the data in the buffer map and those in the comparison map are checked in a step 352. If there is a difference l between the content of the buffer map and that of the comparison map, the operation is advanced to the step 356 to create a steady-state learning map. If there is no difference l, the operation is advanced toward the step 370.

In the step 356, a map-in-creation flag is set to prohibit the writing of the learning results. In a step 358, the content of the buffer map is transferred to the comparison map, and, in a step 360, the creation of a steady-state learning map is done by using the buffer map. In a step 362, the content of the created buffer map is transferred to the learning map, and, in a step 364, the content of the comparison map is transferred to the buffer map. In a step 366, a learning-map-created flag is set. This flag is used in the judgement in the step 350. In a step 368, the map-in-creation flag set in the step 356 is reset.

Figure 9A:
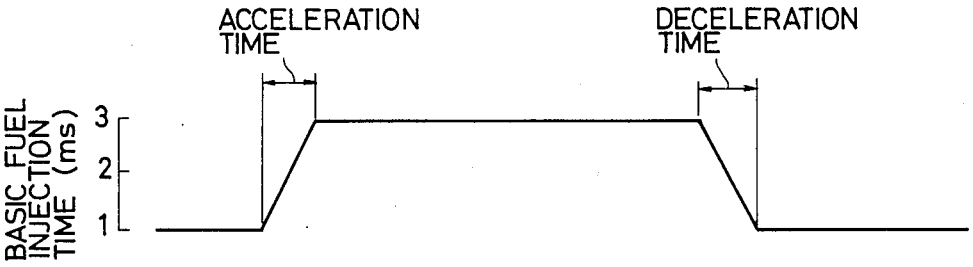
FIG. 9*c* and 9*b* are diagrams showing the air-fuel compensation factors used during the acceleration and deceleration of an engine in the present invention.
Figure 9B:
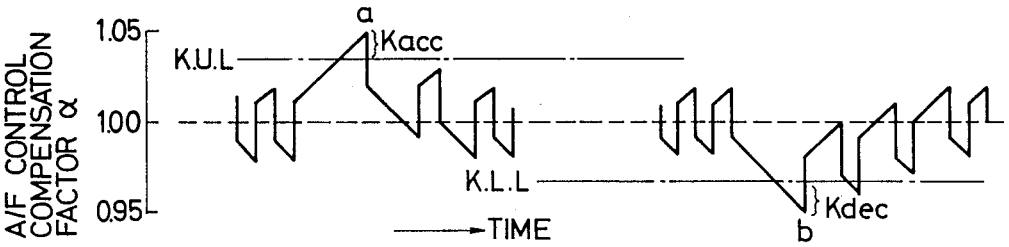

The relation between the basic fuel injection time $t_p$ and air-fuel compensation factor $\alpha$ in a transitional part of the operation of the engine is shown in FIGS. 9A and 9B.

The variations in the transitional condition can be known from the quantity of variation $\Delta T_P$ per hour of the basic fuel injection time $t_p$. In an acceleration period in which $\Delta T_P$ increases, and a deceleration period in which $\Delta T_P$ decreases, the air-fuel ratio compensation factor $\alpha$ has an extreme value a or b. When these extreme values a, b have exceeded an upper limit level (K. U. L.) or become not higher than a lower limit level (K. L. L.), differences Kacc, Kdec are used as transitional learning compensation quantities, i.e. an acceleration learning compensation quantity Kacc and a deceleration learning compensation quantity Kdec. These compensation quantities are written in an acceleration learning map and a deceleration learning map.

Figure 10:
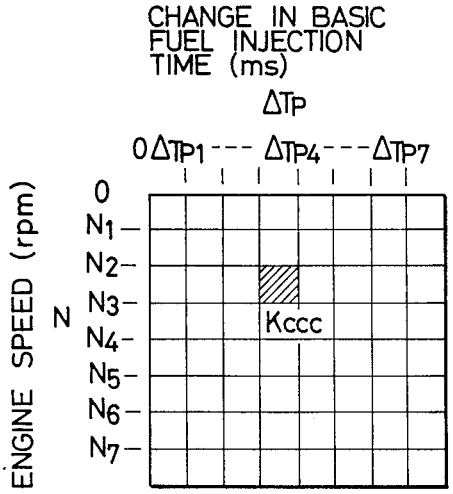
FIG. 10 is a construction diagram of a learning map used during the acceleration of an engine in the present invention.
Figure 11:
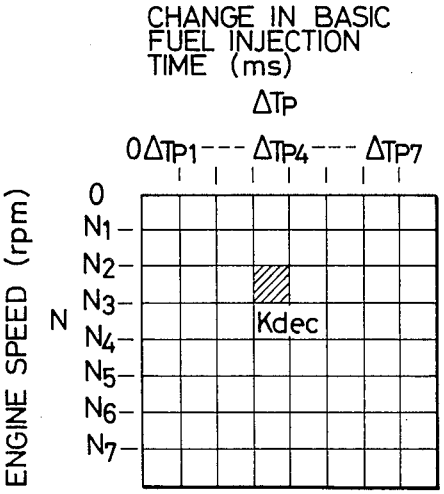
FIG. 11 is a construction diagram of a learning map used during the deceleration of an engine in the present invention.

FIGS. 10 and 11 show an acceleration learning map and a deceleration learning map. Each of these maps consists of variations $\Delta T$ in the basic fuel injection time and the number N of rotations of the engine. In these maps, the dividing points are calculated on the basis of the number N of rotations of the engine at the point in time at which a maximum quantity of variation $\Delta T_P$ per hour of the acceleration period or deceleration period is detected, and the compensation quantities Kacc and Kdec corresponding to an extreme value of the air-fuel compensation quantity at a later point in time are written on the dividing points.

The creation of a transitional map is done after that of a steady-state map.

Figure 12:
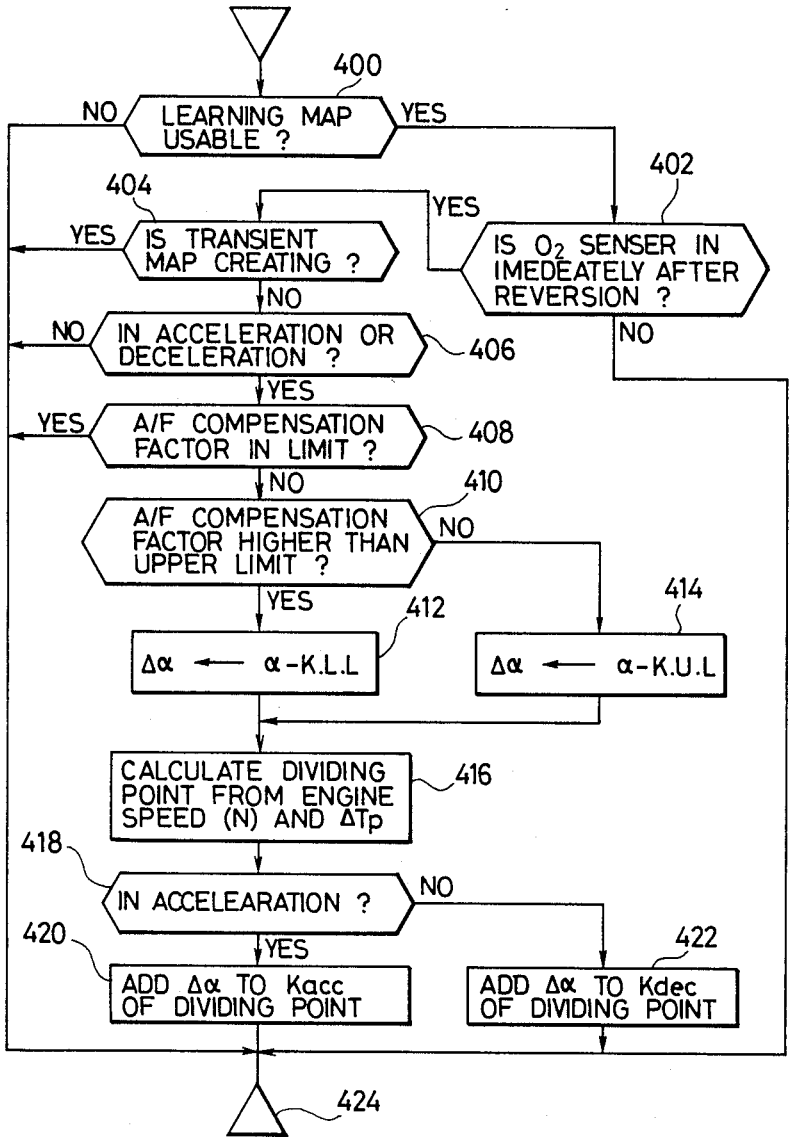
FIG. 12 is a flow chart of an example of an acceleration and deceleration learning operation.

FIG. 12 is a flow chart of an example of transitional learning, which will now be described with reference to the same drawing.

In a step 400, the learning map is checked as to whether it is allowed to be used. If the use of the learning map is prohibited, the operation is advanced toward a step 424. If the learning map is allowed to be used, the operation is advanced to a step 402 to check the oxygen sensor as to whether it has been reversed. If the oxygen sensor has just been reversed, the operation is advanced to a step 404. If the oxygen sensor has not just been reversed, the operation is advanced toward the step 424. In the step 404, the acceleration learning map and deceleration learning map are checked as to whether either of them is being created. If either of these maps is being created, the operation is advanced toward the step 424, and, if not, the operation is advanced to a step 406. In the step 406, the acceleration condition or the deceleration condition is checked. If the engine is in the acceleration/deceleration condition, the operation is advanced to a step 408, and, if not, the operation is advanced toward the step 424. The acceleration/deceleration condition is determined by comparing the variation $\Delta T$ in the basic fuel injection time with a predetermined value. In the step 408, the determination of whether the air-fuel ratio compensation factor $\alpha$ is between the upper and lower limit levels shown in FIG. 9 is made. If the factor $\alpha$ is between these levels, the operation is advanced toward the step 424, and, if not, the operation is advanced to a step 410. If the air-fuel ratio compensation factor $\alpha$ is higher than the upper limit level (K. U. L.) in the step 410, the operation is advanced to a step 412, and, if not, the operation is advanced to the step 414. In both of these steps 412, 414, the acceleration/deceleration learning compensation quantity $\Delta\alpha$is calculated. In a step 416, the dividing points are calculated on the basis of the number N of rotations of the engine at a point in time at which the acceleration/deceleration is detected, and the variation $\Delta T$ in the basic fuel injection time at the same point in time. In a step 418, the determination of whether the point in time at which the acceleration/deceleration is detected is in the period of acceleration or the period of deceleration is made. If it is in the period of acceleration, the acceleration learning compensation quantity $\Delta\alpha$ is added to the acceleration learning map in a step 420, and, if it is in the period of deceleration, the deceleration learning compensation quantity $\Delta\alpha$ is added to the deceleration learning map in a step 422.

Figure 13:
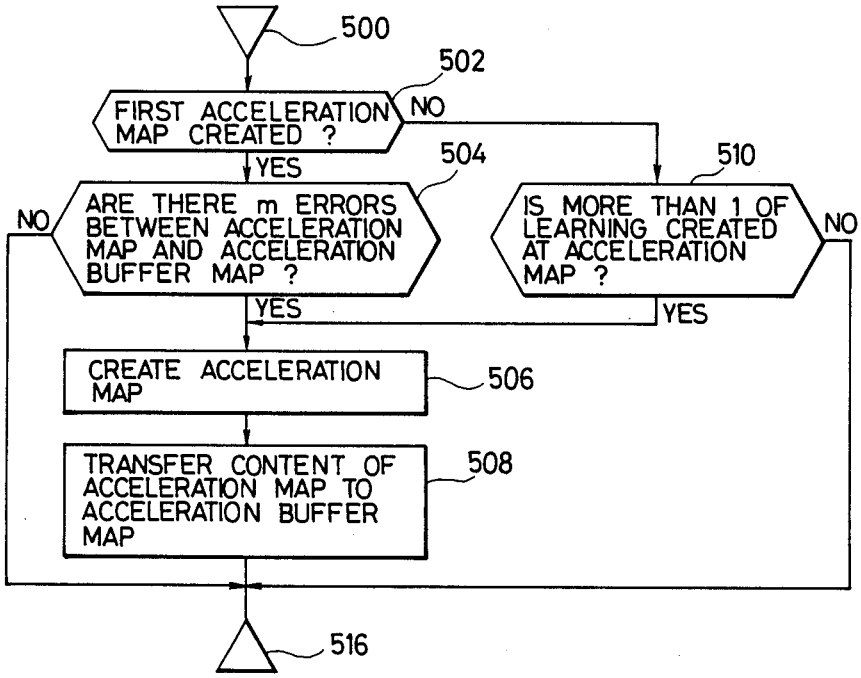
FIG. 13 is a flow chart of an example of an acceleration learning map creating operation.
Figure 14:
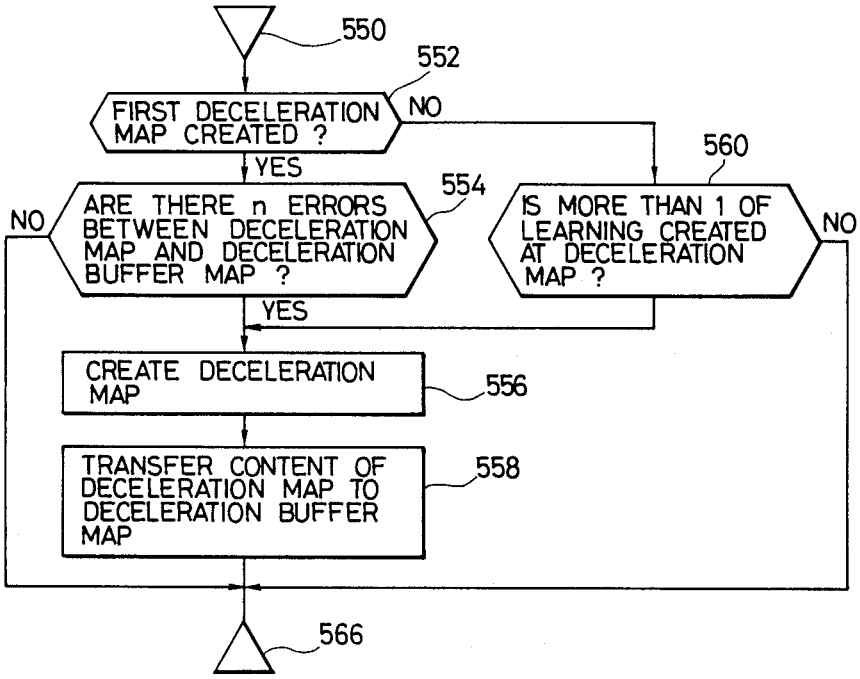
FIG. 14 is a flow chart of an example of a deceleration learning map creating operation.

FIGS. 13 and 14 show examples of processes for creating an acceleration map and a deceleration map. They are provided with an acceleration buffer map and a deceleration map, respectively, as working regions. FIG. 13 shows an example of a process for creating an acceleration map. In a step 502, the determination of whether the creation of a first acceleration map has been done is made. If a first acceleration map has not yet been created, the operation is advanced to a step 510. If at least one learning is done in the step 510, the operation is advanced to a step 506. In the step 506, the creation of an acceleration map is down with consideration given to the weighting illustrated in FIG. 8, and the content of the acceleration map created in the step 508 is transferred to the acceleration buffer map.

If the first map has been created in the step 502, the acceleration map and acceleration buffer map are compared in a step 504. If there is a difference of m pieces, it is regarded as the variation with the lapse of time of an acceleration parameter, and the recreation of acceleration map is done in the step 506 onward.

FIG. 14 shows an example of a process for creating a deceleration map. A description of this process will be omitted since it has the same procedure as the process for creating the acceleration map.

The writing of data in an unlearned region of the acceleration and deceleration maps and the creation of a second map onward are done by the same method as the creation of the steady-state learning map.

The steady-state map and transitional map ar used in the following manner.

The accelerated or decelerated condition of the internal combustion engine is detected. When the engine is in an accelerated state, it is controlled in accordance with the added values, which are from the steady-state map and acceleration map, of the contents of the memories for these maps, which correspond to the operational condition of the engine. When the engine is in a decelerated state, it is controlled in accordance with the added values, which are from the steady-state map and deceleration map, of the contents of the memories for these maps, which correspond to the operational condition of the engine.

According to this embodiment, the learning control operations for all of the learning map, acceleration map and deceleration map can be done by one learning. Therefore, the scatter of and variations with the lapse of time in the characteristics of the sensors and actuators can be compensated, and the compensation learning control for the acceleration/deceleration can be done. Accordingly, the improvement of the exhaust gas component and acceleration/deceleration can be effected speedily by eliminating the deviation of the actual air-fuel ratio from the theoretical air-fuel ratio.

Even in other example, in which a wide-range air-fuel ratio sensor adapted to detect an air-fuel ratio in a wide range of low to high levels is used instead of the oxygen sensor 142, the learning map creating method in the present invention is also effective.

According to the present invention, a highly-accurate learning control operation covering all the operational regions can be carried out with a learning value weighted in accordance with the learning number.

Moreover, the acceleration/deceleration matching can also be done speedily with the acceleration map and deceleration map. Accordingly, the acceleration/deceleration matching corresponding to each type of vehicle be done excellently, and a treatment for the exhaust gas can be done reliably.

What we claim is:

1. A learning control method for an internal combustion engine, having a learning map divided into a plurality of operational regions each receiving data forming the basis of controlling said engine comprising the steps of:

writing data in said regions for controlling said engine; and rewriting data in said regions of said learning map in accordance with the results of controlling said engine and weighted data already obtained by learning with is written in learned regions of said learning map;

wherein weighting of data in the learned regions to be written in unlearned regions of said learning map is done on the basis of the number of learning data already obtained and the location of said learned regions within said learning map relative to the location of said unlearned regions.

2. A learning control method for an internal combustion engine according to claim 1 wherein the writing of data in said unlearned regions is done by writing said weighted data therein, to thereby complete the creation of said learning map.

3. A learning control method for an internal combustion engine according to claim 1, wherein said learning map includes a transitional map used for controlling said internal combustion engine while said engine is in an accelerated/decelerated state.

4. A learning control method for an internal combustion engine according to claim 1, wherein the weighting of data produces a weighting value which is a numerical value less than 1.0 and greater than zero.

5. A learning control method for internal combustion engines according to claim 4 wherein said weighting value becomes closer to 1.0 as the learning number in said learning map increases.

6. A learning control method for an internal combustion engine according to claim 1, wherein said learning map includes a steady-state map used for controlling said internal combustion engine while said engine is a steady state condition, wherein said steady state condition is a state other than an accelerated/decelerated state.

7. A learning control method for an internal combustion engine according to claim 6 wherein said learning map further includes a transitional map used for controlling said internal combustion engine while said engine is accelerated/decelerated, said transitional map being created after said steady-state map has been created, the accelerated state or decelerated state of said engine being detected to control said engine in accordance with added values, which are from said steady-state map and said acceleration map, corresponding to the operational condition of said engine, when said engine is in an accelerated state, and in accordance added values, which are from said steady-state map and said deceleration map, corresponding to the operational condition of said engine, when said engine is in a decelerated state.

8. A learning control method for an internal combustion engine according to claim 1, wherein said plurality of operational regions are provided within said learning map corresponding to operational items, such as the rotational speed of said engine and the magnitude of a load, wherein a compensation factor is written in each operation al region on the basis of a learning value, and wherein the controlling of said engine is performed on the basis of said compensation factor.

9. A learning control method for an internal combustion engine according to claim 8, wherein said method further includes:

a buffer map which is weighted correspondingly to said learning map in accordance with the results of learning based on a feedback control operation, wherein compensation factors are sequentially calculated and stored in said buffer map for said unlearned regions; and a comparison map for storing compensation factors wherein said compensation factors stored in said comparison map are used in determining when new compensation factors are to be rewritten into said learning map using the compensation factors stored in said buffer map.

* * * * *